US006435126B1

(12) United States Patent
Burke

(10) Patent No.: US 6,435,126 B1
(45) Date of Patent: Aug. 20, 2002

(54) RIVER CRAFT WITH OUTBOARD SEAT

(76) Inventor: Morton Frederick Burke, Box 235, Sundre, Alberta (CA), T0M 1X0

( * ) Notice: Subject to any disclaimer, the term of this patent is extended or adjusted under 35 U.S.C. 154(b) by 0 days.

(21) Appl. No.: 09/901,047

(22) Filed: Jul. 10, 2001

(51) Int. Cl.[7] ..... B63B 17/00
(52) U.S. Cl. ..... 114/363; 114/347
(58) Field of Search ..... 114/362, 363, 114/343, 364, 347; D12/302, 317

(56) References Cited

U.S. PATENT DOCUMENTS

| | | | | | |
|---|---|---|---|---|---|
| 3,599,257 | A | * | 8/1971 | Erickson | 114/347 |
| D243,854 | S | * | 3/1977 | Pelkey | D25/63 |
| 4,020,513 | A | * | 5/1977 | Warren et al. | 9/1.5 |
| 4,030,436 | A | | 6/1977 | Stoberl | 114/39 |
| 4,085,473 | A | | 4/1978 | Franklin | 9/1.7 |
| 4,762,081 | A | | 8/1988 | Porter | 114/364 |
| 4,854,534 | A | | 8/1989 | Porter | 248/222 |
| 4,936,243 | A | * | 6/1990 | Shields | 114/363 |
| 6,058,866 | A | | 5/2000 | May | 114/85 |

OTHER PUBLICATIONS 1 drawing page of U.S. Design Patent Des.363, 2 pages.
Abstract and claims of U.S. Patent 3839757, issued Oct. 8, 1974, 2 pages.
Abstract, claims and drawing pages of U.S. Patent 4894032, issued Jan. 16, 1990, 5 pages.
Abstract, claims and drawing pages of U.S. Patent 3855957, issued Dec. 24, 1974, 6 pages.
Abstract and claims of U.S. Patent 3665532, issued May 30, 1972, 2 pages.
Abstract, claims and drawing pages of U.S. Patent 4741284, issued May 3, 1988, 5 pages.
Abstract and first claim of U.S. Patent 5360357, issued Nov. 1, 1994, 2 pages.
Abstract, claims and drawing pages of U.S. Patent 5077929, issued Jan. 7, 1992, 5 pages.
Abstract, claims and drawing pages of U.S. Patent 5163857, issued Nov. 17, 1992, 9 pages.

* cited by examiner

*Primary Examiner*—Ed Swinehart
(74) *Attorney, Agent, or Firm*—Anthony R. Lambert

(57) ABSTRACT

A river craft comprises a hull, such as a canoe hull, having a bow and a stem; and an outboard seat extending outward from one of the stem and the bow. The outboard seat preferably extends from the stem and faces forward, and is lower than the gunwhale of the river craft. The outboard seat comprises a seating platform, and a connecting member connecting the one of the bow and the stem to the seating platform, the seating platform being wider than the connecting member. The hull narrows transversely towards the stem. The stem is sufficiently narrow adjacent the outboard seat to allow the knees of a person sitting on the outboard seat to extend on either side of the stem. The outboard seat may be vertically adjustable or may include a second seating platform lower than the first seating platform. A ballast holder, such as a water tank, at the other end of the river craft may be filled with ballast to balance a person sitting on the outboard seat. A river craft is also provided with a port in the hull between the bow and stem, the port opening downward and having upstanding sides, including a front side and a rear side; and a motor mounted in the port, the motor being fastenable in an operating position below the port and in a retracted position within the port.

13 Claims, 5 Drawing Sheets

RIVER CRAFT WITH OUTBOARD SEAT

BACKGROUND OF THE INVENTION

This invention relates to a river craft, such as may be used for fishing on lakes and streams.

Operating a river craft in shallow water while fishing can be difficult. The river craft may be difficult to hold in place and is prone to tipping. This invention is directed to a river craft designed to allow safe comfortable operation in shallow water, particularly while fishing.

SUMMARY OF THE INVENTION

A river craft according to the invention comprises a hull, such as a truncated canoe hull, having a bow and a stem; and an outboard seat extending outward from one of the stem and the bow. The outboard seat allows an operator to sit outboard of the river craft with feet on the bottom of a river or lake, while maintaining complete control of the river craft. The outboard seat preferably extends from the stem and faces forward, and preferably is lower than the gunwhale of the river craft. The outboard seat preferably comprises a seating platform, and a connecting member connecting the one of the bow and the stem to the seating platform, the seating platform being wider than the connecting member. Preferably, the hull narrows transversely towards the stem. The stem is preferably sufficiently narrow adjacent the outboard seat to allow the knees of a person sitting on the outboard seat to extend on either side of the stem. The outboard seat may be vertically adjustable or may include a second seating platform lower than the first seating platform. A ballast holder, such as a water tank, at the other end of the river craft may be filled with ballast to balance a person sitting on the outboard seat.

According to a further aspect of the invention, a river craft is also provided with an inboard retractable motor. A river craft is provided with a port in the hull between the bow and stem, the port opening downward and having upstanding sides, including a front side and a rear side; and a motor mounted in the port, the motor being fastenable in an operating position below the port and in a retracted position within the port. Preferably, the front side includes a mount for the motor and the rear side includes a mount for the motor.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of invention, in which like numerals denote like elements and in which.

DETAILED DESCRIPTION OF PREFERRED EMBODIMENTS

Figure 1:
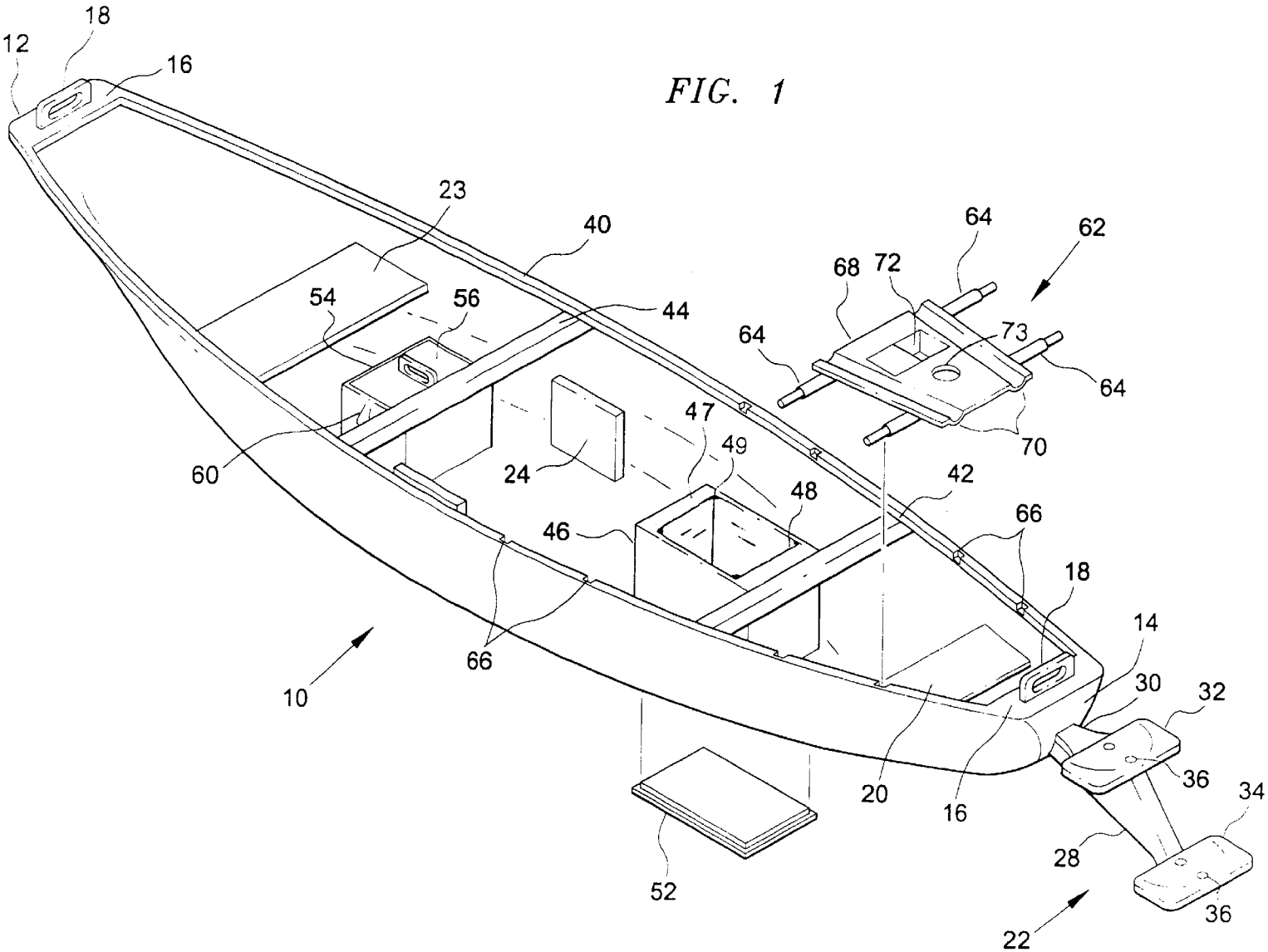
FIG. 1 is a perspective view of a river craft according to the invention.
Figure 2:
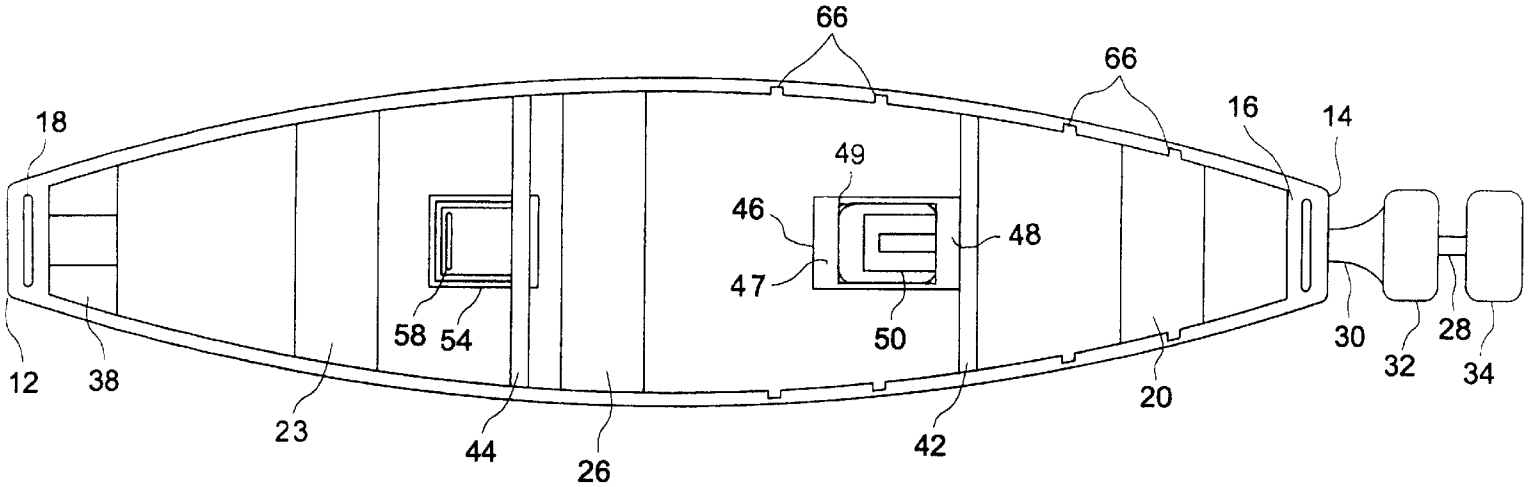
FIG. 2 is a top plan view of the river craft of FIG. 1.
Figure 3:
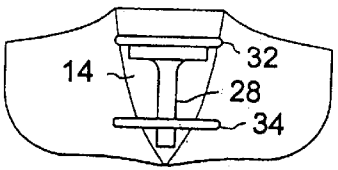
FIG. 3 is a stern view of the river craft of FIG. 1.
Figure 4:
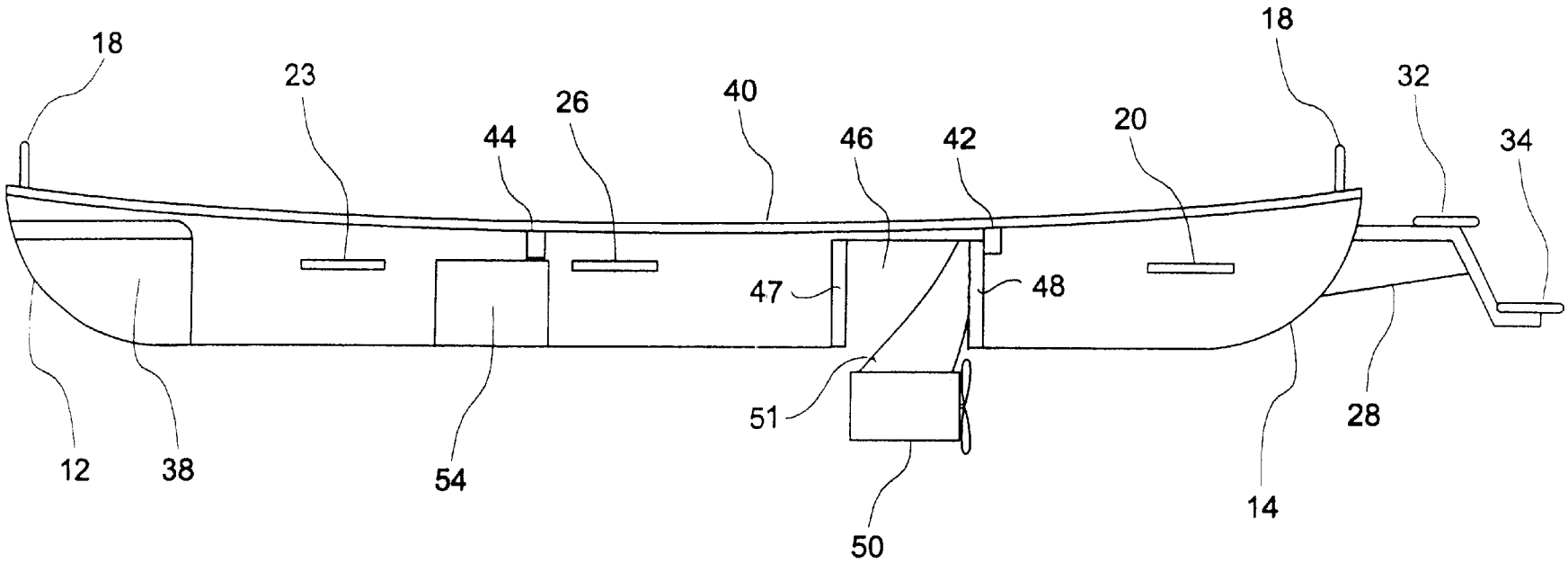
FIG. 4 is a section from bow to stem of the river craft of FIG. 1.

In this patent document, "comprising" means "including". In addition, a reference to an element by the indefinite article "a" does not exclude the possibility that more than one of the element is present.

A river craft 10, which may have the form of a truncated canoe, is shown in FIGS. 1–4. Truncated means that the bow and stem, instead of converging to a point, terminate in a square end, when seen from above. The river craft 10 has a bow 12 and a stem 14 and a gunwhale 40 extending on both sides of the river craft 10 between the bow 12 and stem 14. A portion 16 of the gunwhale 40 widens at the bow 12 and stem 14 to form a location for handles 18 for carrying the river craft 10. Preferably, the handles are formed by openings in the portions 16, but may be upstanding as shown. A rear seat 20 and front seat 23 are mounted in the river craft 10 by conventional methods such as being hung from the gunwhale 40. A middle seat 26 may also be mounted in the river craft 10 by conventional methods, or may be supported by supports 24.

An outboard seat 22 extends outward from the stem 14, but optionally may extend outward from the bow 12, and preferably is located so that the upper seating part of the outboard seat 22 is lower than the gunwhale 40. The outboard seat 22 is preferably shaped and oriented so that the normal sitting position is forward when the outboard seat 22 is mounted from the stem 14. The outboard seat 22 is formed from a seating platform 32 and a connecting member 28 connecting the stern 14 to the seating platform 32. The connecting member 28 is preferably narrower than the seating platform 32, and may be secured in any suitable manner to the seating platform 32, such as by fasteners 36, and to the stem 14. Where the stem 14 has a transom, the connecting member 28 may be secured to the transom. The connecting member 28 may be bolted to, screwed to, welded to, or integrally moulded with the stem 14 or otherwise secured in any conventional manner. The connecting member 28 may also be removably mounted on the stern 14. For stability it is preferred that a cross-piece 30 connect the connecting member 28 to the seating platform 32, with the cross-piece 30 also secured to the stem 14, by any suitable means.

Figure 5:
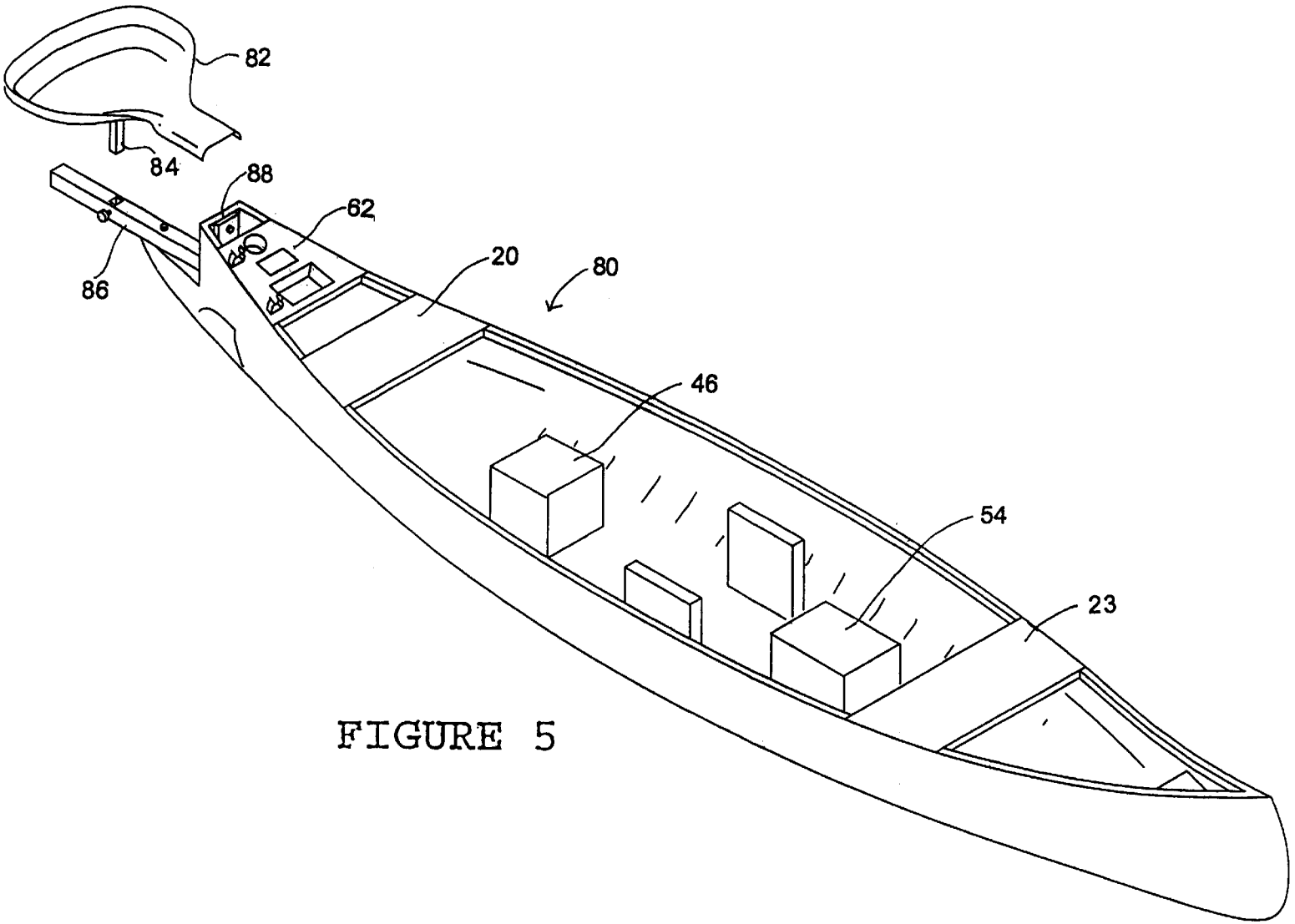
FIG. 5 is a perspective view of an alternative embodiment of a river craft according to the invention.
Figure 6:
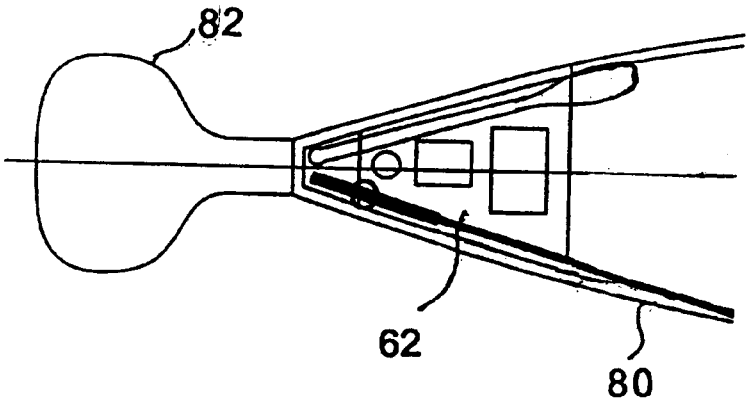
FIG. 6 is a top plan view of one end of the river craft of FIG. 5.

The hull of the river craft 10 preferably narrows transversely towards the stem 14 and bow 12, and, as shown in FIGS. 5 and 6, is sufficiently narrow adjacent the outboard seat 22 to allow the knees of a person sitting on the outboard seat 22 to extend on either side of the stem 14. Thus, it is preferable that the stem width reduces at least to about 6 inches adjacent the outboard seat 22. In this case, the center of the seating platform 32 may be 9 inches from the stem 14. The river craft 10 may widen quickly forward of the stem 14 and reach a width of 12 inches about 10 inches forward of the stem 14. The outboard seat 22 may comprise a second seating platform 34 secured to the connecting member 28 such as by fasteners 36 at a position lower than the seating platform 32.

The outboard seat 22 is used by those who want to fish in shallow water, with their feet on the bottom, even in a hands free position. The outboard seat 22 provides a stable fishing position for a person to sit on with feet in the water, preferably contacting the bottom of the waterway. The lower seating platform 34 provides the same function for deeper water. To prevent the river craft 10 from sinking rearward due to the weight of the person on the outboard seat 22, a ballast holder 38, for example one or more moulded, removable, lidded jugs (tanks) for holding water, is placed at the opposite end of the river craft 10, namely in this case, at the bow 12. The ballast holder 38 should preferably have a capacity, such as 70 liters, to ballast the weight of an average person. Multiple tanks may be used to reduce slosh and reduce weight for filling and emptying the tanks. The bottom surface area of the river craft 10 at the stem may also be enlarged to assist in counteracting the weight of the person on the outboard seat 22 and reduce the amount of ballast required.

To provide ease of trolling, the river craft 10 is also provided with a retractable motor 50. The motor 50 is mounted in a port 46 in the hull between the bow 12 and stem 14. The port 46 opens downward and has upstanding sides, including a front side strengthened with a transom 47 and a rear side strengthened with a transom 48. The transoms 47, 48 should be sufficiently rigid, and at least one and may be up to two inches thick, for supporting a conventional electric motor, which may have a thrust in the order of 50 lb. The transoms 47, 48 and upstanding sides of the port 46 are preferably moulded together and strengthened with reinforced comers 49. A thwart 42 may be provided to support the port 46. The thwart 42 is mounted in conventional manner between the gunwhales 40 on either side of the river craft 10, and may be located at either front or rear of the port 46, depending on structural considerations, such as the location of thwart 44. In an alternative embodiment, the thwart 42 may be used as the motor mount, and in that case may be given additional thickness (in the lengthwise direction of the river craft) and depth, such as 4 inches depth in a central portion where the motor mounts to the thwart 42. The motor 50 is preferably an electric motor that may be mounted, by any conventional means, to one of the transom 47, for operation by a person on the rear seat 20, or the transom 48, for operation by a person on the middle seat 26. The electric motor 50 is provided with a post 51 for securing the motor 50 to either the transom 47 or transom 48. The post 51 may have the form of a rod equipped with a clamp for clamping onto either of the transoms 47, 48. The post 51 may also be provided with any of various fasteners, such as bolts or other suitable means. Whatever means is used to clamp the motor 50 in position, it should be able to be clamped, at upper and lower positions to allow the motor 50 to be fastenable in an operating position below the port 46 (FIG. 4) and in a retracted position within the port 46. In the case of a conventional trolling motor used as the motor 50, the rod may be telescoping and may move vertically through a clamp. The clamp may be constructed, in conventional manner, to clamp one of the transoms 47, 48 and the rod. The motor 50 may then be held in position by operating the clamp. When the clamp opens, the motor 50 may be moved upward or downward with the rod, then the clamp is closed onto the rod to hold it in the desired position. When the motor 50 is not in use, a cover 52 may be placed on the bottom of the port 46 and secured in any conventional manner to prevent splashing into the motor port 46. A battery holder 54 with cover 56 is provided, for example secured to the thwart 44, for holding a battery to power the motor 50. A cover, not shown, may also be used for the top of the port 46.

Various additional features may be provided to enhance the boating pleasure of the operator of the river craft 10. A removable rack 62 mounted on rods 64 may be held in slots 66 in the gunwhale 40. The rack 62 has a deck 68 with paddle holding slots 70, waterproof compartment 72 for holding, for example, a camera, and a cup holder 73.

Figure 7:
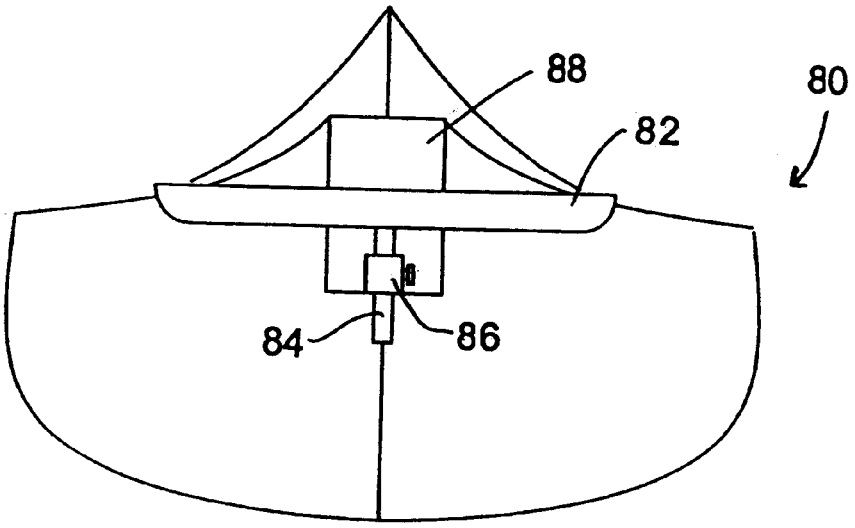
FIG. 7 is a stern view of the river craft of FIG. 5.

Referring to FIGS. 5, 6 and 7, the outboard seat 82 may have the shape of a tractor seat and may be secured by a post 84 to a bar 86 that attaches to a transom 88 on the stem 14 of a river craft 80. The outboard seats 22, 82 are preferably adapted to suit a single person, and may be mounted to be adjustable up and down. Holes in the outboard seat may be provided to allow drainage of water.

The river craft 10 may have a flat bottom for stability, and some may prefer this. Others may desire a more maneuverable river craft with a somewhat less flat bottom. The river craft 10 may also be provided with a keel, not shown. The river craft 10 may be operated by one person from the rear seat 20 or outboard seat 22 with suitable ballast, and a battery in the battery box 54, if present, providing additional balance. The river craft 10 may also be operated by two persons, without ballast, with the forward person suitably far forward to counteract a person on the outboard seat 22.

The river craft may be made of any suitable materials such as plastics, wood, metal, for example aluminum, and composites, and the manner of construction will depend on the material used, in accordance with conventional boat building techniques. Plastics are preferred. The dimensions of the river craft will also vary depending on various factors, but in one example the river craft could be 144 inches from stem to bow, 108 inches from stem to front seat, 92 inches from stem to battery box, 79 inches from stem to motor well, 18 inches from stem to rear seat, with depth of stem and bow at 17 inches, depth at center 13 inches, bottom of seats to bottom at 8 inches, width at center at 36 inches. For the outboard seat 22, the center of the lower seat may be 18 inches to the stem, the center of the upper seat may be 9 inches from the stern, the stern width at the very rear most of the river craft may be 4.5 inches, the top of the stem to the upper seat may be 3 inches, the top of the upper seat to the top of the lower seat may be 10 inches. The connecting member 28, which functions as a bracket, may be moulded into the river craft. The bow and stem shape may be similar to that of a canoe with the ends cut off (truncated), though the comers should be rounded (for example a 2 inch radius) and the bottom of the river craft should merge gradually into the stem and bow. The motor port may have a length of 16 inches, width 10 inches, and rise to the level of the thwart 42. The thwart 42 is preferably thickened (for example 4 inches thick) at the middle to act as a transom for the motor 50. The top of the thwart 42 may be 1½ inches lower than the gunwhale to allow rods and paddles to rest on the thwarts without falling into the water.

The cover of the battery box should have shrouded openings for the battery wires to pass through, and may be secured with thumb screws or wing nuts. The battery box may have a flat tray with handles to assist in putting the battery in and removing it. The poles on the rack may be made telescoping to allow them to be placed elsewhere on the river craft in slots in the gunwhale (not shown) for that purpose. The rack may be spaced from the carry handle at the stem at about 10 inches to allow space for paddles. The seats may be made of plastic and contoured to fit comfortably. The seats may be made removable by having them fit into slots on the gunwhale, although it is preferable that seats be hung such that the top of the seats are 1.5 inches below the gunwhale.

Immaterial modifications may be made to the invention described here without departing from the essence of the invention.

The embodiments of the invention in which an exclusive property or privilege is claimed are defined as follows:

1. A river craft, comprising:

a hull having a bow and a stern, the hull having a gunwhale; and an outboard seat extending outward from the stem, the outboard seat facing forward and extending outward from the stern at a level lower than the gunwhale.

2. The river craft of claim 1 in which the outboard seat extends from the stem and faces forward.

3. A river craft, comprising:

a hull having a bow and a stern, the hull having a gunwhale;

an outboard seat extending outward from one of the stem and the bow, the outboard seat extending outward from the one of the stern and the bow at a level lower than the gunwhale;

the outboard seat comprising a seating platform and a connection between the one of the bow and the stem and the seating platform, the seating platform being wider than the connection.

4. A river craft, comprising:

a canoe hull having a bow and a stem, the canoe hull having a gunwhale;

an outboard seat extending outward from one of the stern and the bow, the outboard seat extending outward from the one of the stern and the bow at a level lower than the gunwhale; and the hull narrowing transversely towards the one of the stern and the bow from which the outboard seat extends.

5. The river craft of claim 4 in which the one of the stem and bow from which the outboard seat extends is sufficiently narrow abjacent the outboard seat to allow the knees of a person sitting on the outboard seat to extend on either side of the one of the stern and bow.

6. The river craft of claim 1 in which the outboard seat comprises a first seating platform and a second seating platform lower than the first seating platform.

7. The river craft of claim 4 in which the outboard seat extends rearward from the stern.

8. The river craft of claim 3 in which the hull is a truncated canoe hull.

9. The river craft of claim 1 in which the hull has a gunwhale, and the outboard seat extends outward from the one of the stem and the bow at a level lower than the gunwhale.

10. The river craft of claim 3 further comprising a ballast holder at the other of the bow and the stern.

11. The river craft of claim 10 in which the ballast holder comprises a tank.

12. A seat for a river craft, in which the river craft has a stern and a gunwhale, the seat comprising;

a seating platform;

a connecting member secured to the seating platform, the connecting member being adapted for connecting the seating platform to the stern of the river craft, with the seating platform outboard of the river craft and below the gunwhale; and the seating platform facing forward.

13. A seat for a river craft, in which the river craft has a stem, a bow and a gunwhale, the seat comprising;

a seating platform;

a connecting member secured to the seating platform, the connecting member being adapted for connecting the seating platform to one of the stern and the bow of the river craft, with the seating platform outboard of the river craft and below the gunwhale; and the connecting member in use forming a connection between the seating platform and the river craft that is narrower than the seating platform.

* * * * *